United States Patent [19]

Bunn et al.

[11] 4,447,193

[45] May 8, 1984

[54] COMPRESSOR UNLOADER APPARATUS

[75] Inventors: Stuart E. Bunn; Herbert B. Owsely, both of Shawnee Mission, Kans.

[73] Assignee: Ball Valve Co., Inc., Olathe, Kans.

[21] Appl. No.: 285,251

[22] Filed: Jul. 20, 1981

[51] Int. Cl.[3] ..... F04B 41/00

[52] U.S. Cl. ..... 417/441

[58] Field of Search ..... 417/440, 441, 292, 295

[56] References Cited

U.S. PATENT DOCUMENTS

| | | | |
|---|---|---|---|
| 1,291,854 | 1/1919 | Haight . | |
| 1,623,489 | 4/1927 | Naab . | |
| 1,653,110 | 12/1927 | Le Valley . | |
| 1,796,796 | 3/1931 | Le Valley . | |
| 1,985,642 | 12/1934 | Moody . | |
| 2,008,809 | 7/1935 | Wyld . | |
| 2,047,167 | 7/1936 | Heller . | |
| 2,141,069 | 12/1938 | Newell . | |
| 2,726,032 | 12/1956 | Cooper et al. . | |
| 2,751,143 | 6/1956 | Biehn . | |
| 2,833,462 | 5/1958 | Sheerer . | |
| 3,045,892 | 7/1962 | White . | |
| 3,061,176 | 10/1962 | Nicholas et al. | 417/441 |
| 3,076,593 | 2/1963 | Newton . | |
| 3,295,748 | 1/1967 | Leitgab . | |
| 3,518,032 | 6/1970 | Degroff et al. . | |
| 3,759,057 | 9/1973 | English et al. | 417/292 X |
| 3,791,776 | 2/1974 | Grant . | |
| 4,043,710 | 8/1977 | Bunn et al. . | |
| 4,326,839 | 4/1982 | Fry | 417/295 |

OTHER PUBLICATIONS

Ball Valve Company, A New Concept, The Ball Valve 4-C System.

*Primary Examiner*—Richard E. Gluck

*Attorney, Agent, or Firm*—Litman, Day & McMahon

[57] ABSTRACT

An unloader apparatus for a gas compressor having a compressor cylinder and a reciprocating compressor piston slidable in the compressor cylinder. The unloader apparatus comprises a hollow sleeve positioned in a suction line of the gas compressor with a port therethrough for communicating gas from the suction line to a suction valve. An unloader piston is slidably disposed within the hollow sleeve and is movable between an open position opening the port whereby gas flow to the suction valve is prevented and a closed position closing the port. In its closed position, the unloader piston seals the compressor cylinder and the compressor piston reciprocates in a partial vacuum. Actuating means connected to the unloader piston is provided for moving the piston between its respective positions. The actuating means utilizes high pressure gas from the discharge side of the compressor for sliding the unloader piston between its positons and exhausts the gas to the suction side of the compressor.

18 Claims, 4 Drawing Figures

COMPRESSOR PISTON

DISCHARGE
135
134
133
130
131
138
136
137
132
139
140
141
1
107a
105a
90a
101a
103a
93a
91a
94a
95a
92a
102a
97a
96a
75a
99a
100a
13a
84a
83a
82a
41a
120
40a
121
49a
12a
54a
50a
106a
66a
45a
47a
122
48a
46a
53a
57a
62a
120

COMPRESSOR UNLOADER APPARATUS

BACKGROUND OF THE INVENTION

1. Field of the Invention

This invention relates to gas compressor unloaders, and in particular to an unloader for use in gas transmission and refrigeration compressors.

2. Description of the Prior Art

In the operation of gas compressors having compressor cylinders with compressor pistons reciprocating therein, it is frequently desirable to reduce the volumetric output of the compressor. Variable speed motors may be used for adjusting the output of such reciprocating-type compressors, however, the gas pressures, torque and work done per revolution remain constant when only the engine speed is varied. Adjusting pressure cylinder capacity by unloading means is therefore preferable because torque, capacity, and power consumption per revolution may also be reduced thereby. Also, unloader devices which vary compressor cylinder capacity are adaptable for use with synchronous motors, thereby avoiding the additional expense and complexity of variable speed motors.

Such compressor cylinder capacity may be controlled by a variety of different devices. By way of example, a compressor cylinder end may be deactivated by physically lifting the suction valves to an unloaded position with a mechanical linkage system extending through the valve cap cover or by completely removing the suction valves. However, valve assemblies are difficult to move when subjected to the relatively high gas pressures within the gas compressor and the required mechanical linkage tends to cause difficulty in maintaining a gas-tight seal. Also, removing a suction valve assembly is generally not possible with the compressor in operation.

Another prior art method of unloading compressor cylinders is characterized by the use of mechanical fingers which extend through air passages in a valve seat for selectively holding the valve members in their open positions whereby virtually infinite clearance is provided and no compression occurs. However, the fingers are susceptible to breakage and occupy space within the gas passages thereby increasing flow resistance and gas temperatures.

Two other methods of unloading compressor cylinders are exemplified in our U.S. Letters Patent No. 4,043,710 wherein a clearance bottle is disclosed selectively communicating with a compressor cylinder and an unloader piston is provided for selectively communicating the compressor cylinder with suction passages. However, clearance bottles are limited by their volume in the amount of unloading capacity they can provide and such unloader pistons are limited in their application to valve assemblies having central passages therethrough.

In refrigeration gas compressors, it is generally desirable for an unloader mechanism to control compressor cylinder capacity in response to an operating condition of the system, such as temperature or gas pressure. Although it is known to automatically unload a reciprocating compressor in response to an operating condition of a refrigeration system, a relatively powerful actuating mechanism was typically required to overcome the relatively high differential gas pressures within the compressor and thereby move an unloader mechanism to its unloaded position. See, for example, the Moody Pat. No. 1,985,642 and the Cooper Pat. No. 2,726,032.

Prior art compressor unloaders, however, tended to be either complex in structure and manufacture, susceptible to breakage and other maintenance problems, and detrimental to the efficiency of a compressor.

SUMMARY OF THE INVENTION

In the practice of the present invention, an unloader apparatus is provided for a gas compressor having a compressor cylinder, a reciprocating compressor piston slidably disposed therein, a suction line and a suction valve communicating the suction line and the compressor cylinder. The compressor unloader comprises a ported sleeve communicating with the suction line and having a port for the flow of gas therethrough. An unloader piston is slidably disposed in the ported sleeve and is movable between a closed position whereat the sleeve port is blocked to gas flow therethrough and an open position whereby gas may flow through the port to the suction valve and into the compressor cylinder.

Actuating means for moving the unloader piston between its open and closed position comprises an actuator cylinder with an actuator piston slidably disposed therein. The actuator cylinder has first and second ends respectively receiving an actuating fluid for moving the actuator piston between its first and second positions. The actuator piston is operably coupled to the unloader piston.

A modified embodiment of the present invention comprises an unloader for a compressor in a refrigeration system with actuating means responsive to an operating condition of the refrigeration system. The actuating means includes a pilot valve for communicating gas from a compressor discharge line to the first and second ends of the actuator piston respectively. The pilot valve includes a member movable between first and second positions for directing the actuating fluid to the respective end of the actuator cylinder. The pilot valve member is operably connected to and movable between its respective positions by a solenoid or a pressure diaphragm actuated by a thermostat.

OBJECTS OF THE INVENTION

The principal objects of the present invention are: to provide an apparatus for controlling the capacity of a gas compressor; to provide such an apparatus which includes an unloader piston slidably disposed within a hollow ported sleeve positioned between a suction line and a suction valve; to provide such an apparatus wherein the unloader piston is movable between a closed position blocking gas flow from the suction line to the suction valve and an open position by actuating means; to provide such an apparatus which completely unloads an end of the compressor; to provide such an apparatus which substantially reduces the work load on an unloaded end of the compressor; to provide such an apparatus wherein the actuating means is responsive to an operating condition of a refrigeration system; to provide such an apparatus wherein the actuating means includes an actuator piston slidably disposed in an actuator cylinder and coupled to the unloader piston; to provide such an apparatus wherein the actuating means receives fluid from a discharge line of the compressor; to provide such an apparatus wherein the actuating means comprises a closed system with the suction line and the discharge line of the compressor; to provide such an apparatus with a hollow unloader piston; to provide an apparatus which controls the output of a reciprocating-type compressor at constant motor speed; to provide such an apparatus which reduces the amount of work per revolution done by the compressor motor when the compressor is unloaded; to provide such an apparatus which allows the compressor to be run with no output; to provide such an unloader apparatus which offers minimal resistance to gas flow through the compressor; to provide such an unloader apparatus which is not particularly susceptible to breakage; to provide such an unloader apparatus with relatively few moving parts; to provide such an unloader apparatus which is relatively simple to make fluid-tight; to provide such an apparatus wherein relatively low powered actuating means may be employed to move the unloader piston between its open and closed positions; to provide such an apparatus which is particularly well adapted for use with compressors in refrigeration systems and gas transmission systems; to provide such an unloader apparatus which is particularly well adapted for use with single deck suction valves; and to provide such an apparatus which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

Figure 2:
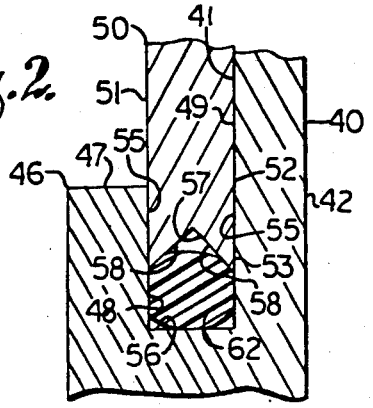
FIG. 2 is an enlarged, fragmentary, vertical, cross-sectional view of the unloader apparatus particularly showing sealing means between a ported sleeve and an unloader piston.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper", "lower", "vertical", "horizontal", and derivatives thereof shall relate to the invention as oriented in the drawings, however, it is to be understood that the invention may assume various alternative orientations, except where expressly specified to the contrary.

Referring more in detail to the drawings:

The reference numeral 1 generally designates a compressor unloader apparatus for a gas compressor 2 having a compressor cylinder 3 with a reciprocating compressor piston (not shown) slidably disposed therein. The gas compressor 2 has a suction chamber 4 communicating with a suction valve assembly 5 for one-way gas flow from the suction chamber 4 to the compressor cylinder 3. The suction valve assembly 5 is positioned in a cylindrical suction valve opening 6 in a frame member 7 of the gas compressor 2 and has an inlet and an outlet side 9 and 10 respectively.

The suction valve assembly 5 comprises a cage structure 11 having a plurality of poppet valve guide bores 12 extending thereinto. A plurality of outlet passages 13 open onto the valve assembly outlet side 10 and communicate gas with the compressor cylinder 3. The cage structure 11 has a peripheral shoulder 14 which engages an associated compressor frame shoulder 15 encircling the suction valve opening 6. A valve seat structure 21 has a plurality of inlet passages 22 therethrough opening onto a valve assembly inlet side 9 and each terminating in a respective valve seat or mating surface 23. The valve seat structure 21 has a peripheral shoulder 24 and is attached to the cage structure 11 by a locking screw 25. The cage structure 11 and the valve seat structure 21 are properly aligned with respect to each other by a guide pin 26.

The suction valve assembly 5 includes a plurality of lift-type poppet valve members such as that shown at 30 each having a valve stem 31 slidably disposed within a respective guide bore 12 and a valve head 32 selectively engaging a respective valve seat 23 and providing a fluid-tight seal therebetween. The poppet valve member 30 is slidably movable between a closed position (as shown) with its valve head 32 engaging the valve seat 23 to prevent gas flow through the inlet passage 22 and an open position. In its open position the head 32 is spaced from the valve seat 23 and gas is communicated from the suction chamber 4 through the inlet passage 22 and the outlet passage 13 and into the compressor cylinder 3. The poppet valve member 30 is urged into seating engagement with the seat structure 21 by an elongated helical spring 34 positioned within the guide bore 12 and the valve stem 31.

The poppet valve members 30 are of the automatic lift-type which are opened by a pressure differential between the suction chamber 4 and the compressor cylinder 3 across the suction valve assembly 5. When the compressor piston (not shown) moves away from the suction valve assembly 5 on its suction stroke, the gas pressure within the compressor cylinder 3 decreases until a sufficient pressure differential is achieved whereby the gas pressure within the suction chamber 4 "lifts" the poppet valve member 30 downwardly to its open position and gas is communicated from the suction chamber 4 into the compressor cylinder 3. When the compressor piston (not shown) reciprocates on its discharge stroke, the poppet valve member 30 is in its closed position as shown and the compressed gas is discharged through a discharge valve assembly (not shown), thereby completing a compressor cycle.

A tubular sleeve 40 is positioned within the suction valve opening 6 coaxial with the suction valve assembly 5 and has an inner surface 41 defining a central passage 49, an outer surface 42, a lower end 43 and an upper end 44. The sleeve lower end 43 engages the seat structure shoulder 24 in abutting relationship. A plurality of circumferentially spaced ports 45 extend radially through the sleeve 40 between its inner and outer surfaces 41 and 42 respectively. An annular shoulder 46 having an upper surface 47 is positioned below the ports 45 and extends inwardly from the sleeve inner surface 41. A circular slot 48 coaxial with the sleeve 40 opens upwardly onto the annular shoulder upper surface 47 and has a rectangular cross-sectional configuration with opposed side surfaces 55 and a bottom surface 56 (FIG. 2).

Figure 1:
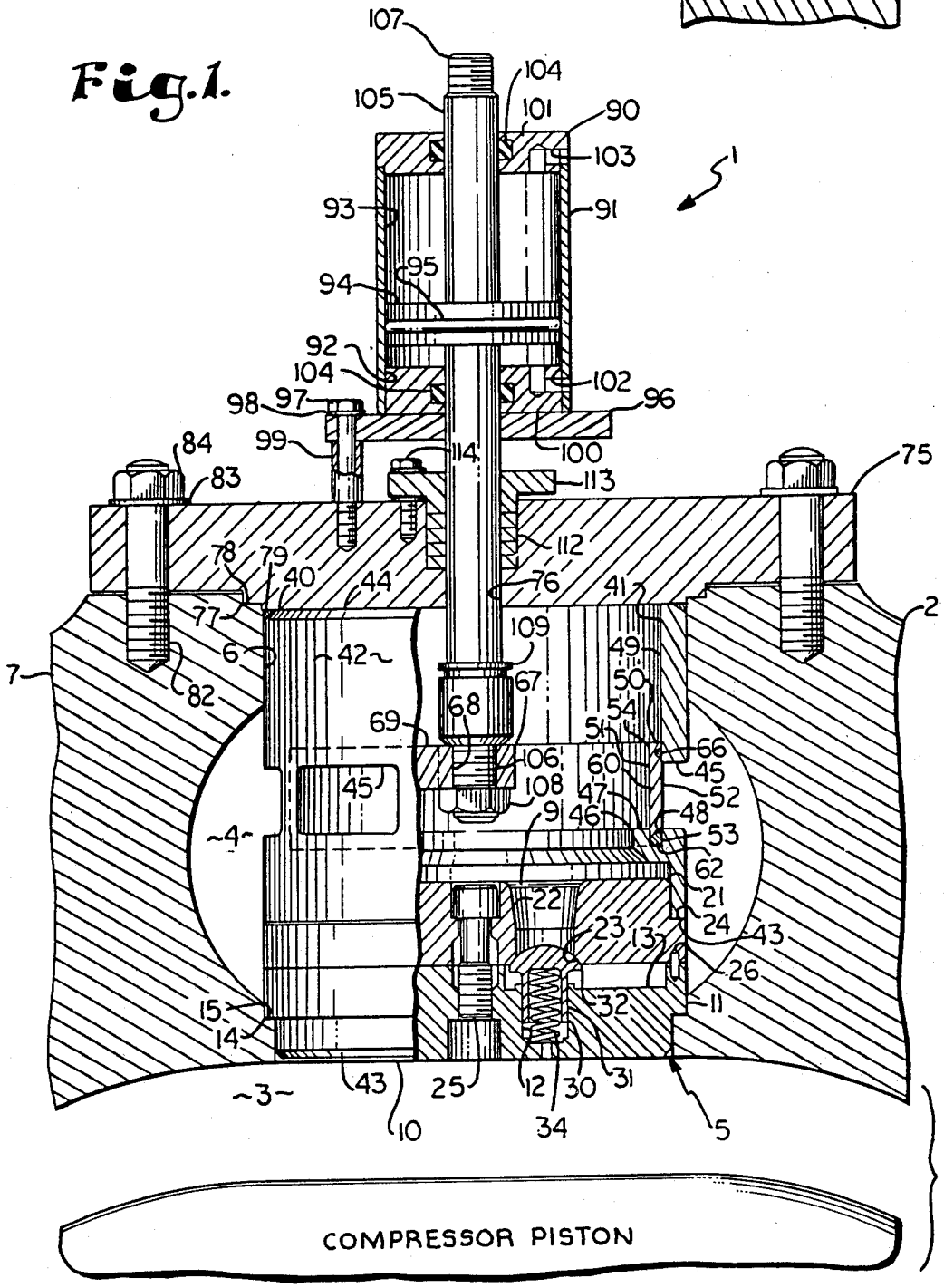
FIG. 1 is a fragmentary, vertical, cross-sectional view of a suction valve and an unloader apparatus embodying features of the present invention and postioned for unloaded operation.

A tubular unloader piston 50 coaxial with the valve assembly 5 is slidably disposed within the sleeve central passage 49 and has an inner surface 51 defining a piston central passage 60, an outer surface 52, a lower end 53 and an upper end 54. The unloader piston 50 is aligned with the slot 48 and its lower end 53 is received therein when the piston 50 is in its closed position as shown in FIG. 1. A groove 57 extends upwardly from the unloader piston lower end 53 and is defined by a pair of upwardly converging side surfaces 58 as shown in FIG. 2. An elastomeric O-ring is positioned within the slot 48.

The groove 57 on the piston lower end 53 cooperates with the rectangular cross-sectional slot 48 to provide an enclosure 59 with five surfaces, the side surfaces 55 and the bottom surface 56 of the slot 48 and the side surfaces 58 of the groove 57 respectively. With the unloader piston 50 in its closed position, it deforms the O-ring 62 into a gas-tight engagement with the respective surfaces 55, 56, and 58 whereby pressurized gas is effectively prevented from leaking between the sleeve 40 and the unloader piston lower end 53.

An O-ring 66 encircles the hollow piston 50 adjacent its upper end 54 and provides a gas-tight sealing engagement between the sleeve inner surface 41 and the hollow piston 50. The unloader piston 50 includes a coaxial hub 67 with a coaxial aperture 68 therethrough. A plurality of spokes 69 extend radially from the hub 67 to the unloader piston inner surface 51.

The suction valve assembly 5 and the ported sleeve 40 are retained within the suction valve opening 6 by a valve cover 75 having an aperture 76 therethrough and a shoulder 77 coaxial with the aperture 76 and the valve assembly 5. The valve cover shoulder 77 engages a shoulder 78 on the compressor frame 7 whereby the valve cover 75 is correctly positioned with respect to the suction valve opening 6. An O-ring 79 is positioned at the juncture of the compressor frame 7, the sleeve chair upper end 44 and the valve cover 75 for effecting a gas-tight seal between these three elements. The valve cover 75 is attached to the compressor frame 7 by suitable fastening means such as the bolts 82 having washers 83 and nuts 84.

A pneumatic actuator assembly 90 is provided for moving the unloader piston 50 between its closed position blocking the sleeve ports 45 and its open position whereby gas is allowed to flow therethrough. The pneumatic actuator assembly 90 comprises an actuator cylinder 91 coaxially aligned with the ported sleeve 40 and having a lower and an upper end 92 and 93 respectively. The lower and the upper actuator cylinder heads 100 and 101 respectively have a lower and an upper fluid port 102 and 103 respectively for communicating a pressurized actuating fluid from a suitable source (not shown) to the actuator cylinder ends 92 and 93 respectively. An actuator piston 94 is slidably disposed within the actuator cylinder 91 between the actuator cylinder ends 92 and 93. An annular elastomeric ring 95 encircles the actuator piston 94 and provides a fluid-tight seal between the actuator cylinder ends 92 and 93. The base 96 attached to the valve cover 75 by a suitable fastening means such as the bolt 97 extending through a washer 98, the actuator assembly base 96 and into the valve cover 75. A spacer 99 is provided between the valve cover 75 and the actuator assembly base 96 for maintaining a proper spacing therebetween.

The unloader piston 50 and the actuator piston 94 are coupled together in axially spaced relation by a connecting rod 105 having a lower and an upper threaded end 106 and 107 respectively. The connecting rod lower end 106 extends through the unloader piston hub aperture 68 and is attached to the unloader piston hub 67 by means of a nut 108 positioned below the hub 67 and a swivel 109 attached to the connecting rod 105 above the hub 67. The actuator piston 94 receives and is fixedly attached to the connecting rod 105. The connecting rod 105 extends through and is slidable with respect to the valve cover plate 75, the actuator assembly base 96, and the actuator cylinder heads 100 and 101. A rod packing gland 112 encircles in sealing relation the connecting rod 105 and is retained within the valve cover aperture 76 by a packing gland retainer 113 attached to the valve cover 75 by bolts 114. Suitable packing glands 116 are provided in the lower and upper cylinder heads 100 and 101 respectively and encircle the connecting rod 105 for effecting a fluid-tight seal with respect thereto. Signal means (not shown) may be attached to the connecting rod upper end 107 and viewed as an external indicator of the position of the hollow unloader piston 50 within the ported sleeve 40.

With the unloader piston 50 in its closed position as shown in FIG. 1, the ports 45 are blocked off and the suction valve assembly 5 deactivated. With all of its suction assemblies such as that shown at 5 deactivated in this manner, the entire end of the compressor 2 will thus be deactivated and its respective gas output eliminated. A partial vacuum will thus be created within the compressor cylinder 3, with the remaining gas therein achieving a maximum pressure slightly less than that required to open the discharge valve. The compressor 2 may thus be allowed to continue to run at its normal speed, except that a substantial amount of work will be saved and the torque load placed upon its prime mover reduced because the compressor piston reciprocates within a partial vacuum in the unloaded end of the compressor cylinder 3.

By controlling the capacity output of the compressor 2 in this manner, a substantial amount of energy may be saved which would otherwise be required to reciprocate the compressor piston within the compressor cylinder 3 under the gas pressures associated with normal loaded operating conditions. For example, tests have indicated about a 98% reduction in the work load required to run the compressor 2 in its completely unloaded condition from that required to operate the compressor 2 fully loaded.

In its unloaded condition, the amounts of work expended by the compressor 2 in compressing gas within the compressor cylinder 3 are regained because the gas thus compressed reciprocates the compressor piston, thereby saving the work which would otherwise be expended on the compressor return stroke. Therefore, the workload on the compressor 2 associated with alternately compressing and expanding a given volume of gas within the compressor cylinder 3 with the unloader piston 50 in its closed position is substantially nill. The relatively small amount of work load expended by the compressor 2 operating in its unloaded condition comprises primarily parasitic losses due to friction and heat dissipation.

To activate the compressor valve assembly 5 and thereby place a respective end of the gas compressor 2 in a loaded mode of operation with normal output capacity, the actuating fluid is directed through the lower fluid port 102 and into the actuator cylinder lower end 92 whereby the actuator piston 94 is forced upwardly and the actuating fluid driven out of the actuating cylinder upper end 107 through the upper fluid port 103. The unloader piston 50 is thus slid upwardly within the sleeve central passage 49, opening the ports 45 to gas flow therethrough whereby gas is communicated from the suction chamber 4 to the suction valve assembly 5. To return the compressor unloader assembly 1 to its unloaded condition, as shown in FIG. 1, the actuating fluid is directed through the upper fluid port 103 into the actuator cylinder upper end 93 whereby the actuator piston 94 is forced downwardly and the actuating fluid is forced out of the actuator cylinder lower end 92 through the lower fluid port 102. The unloader piston 50 is thus slid downwardly within the sleeve chair central passage 49 until its lower end 53 extends into the sleeve chair slot 48 and a gas-tight seal is effected by the O-ring 62 between the sleeve 40 and the unloader piston 50. The actuating fluid may comprise, for example, compressed air or hydraulic fluid and is directed by suitable means (not shown) into either of the actuator cylinder ends 92 or 93.

The central passage 60 of the unloader piston 50 reduces its exposure to buffeting by gas pressures passing through the suction valve assembly 5. Also, the hollow unloader piston 50 presents less area to be subjected to differential gas pressures which would otherwise tend to force it toward its open or closed position and restrict its free movement therebetween within the sleeve central passage 49. Therefore, the actuator assembly 90 is required to be only as powerful as is necessary to overcome the seal friction between the unloader piston 50 and the sleeve central passage 49. The unloader apparatus 1 of the present invention is thus particularly well adapted for operation in gas compressors 2 having relatively high differential gas pressures and may also be utilized in gas compressors 2 wherein automatic unloader mechanisms were previously not feasible.

The reference numeral 1*a* (FIG. 3) generally represents a modified embodiment of the unloader apparatus of the present invention positioned in a suction line of a refrigeration system and having a pilot valve for directing an actuating fluid. Since the unloader assembly 1*a* is otherwise substantially the same as the previously described apparatus 1, similar parts appearing in FIG. 3 and FIGS. 1 and 2 respectively are represented by the same corresponding reference numeral except for the addition of the suffix "a" to the numerals of the modified device.

The modified unloader apparatus 1*a* is positioned in a suction line 120 of a gas compressor (not shown) in a refrigeration system. The suction line 120 communicates gas with a suction valve assembly (not shown) in the gas compressor. The suction line 120 includes a cylindrical unloader apparatus opening 121 encircled by a suction chamber 122. The unloader apparatus 1*a* includes a tubular ported sleeve 40*a* with an inner surface 41*a* defining a central passage 46*a* therethrough. The sleeve 40*a* has a plurality of circumferentially spaced ports 45*a* extending therethrough for communicating gas from the suction chamber 122 into the central passage 49*a*. The sleeve 40*a* includes an annular shoulder 46*a* with a slot 48*a* opening upwardly onto an upper surface 47*a* thereof.

A hollow unloader piston 50*a* has a lower end 53*a* with a groove 57*a* defined by a pair of upwardly-converging surfaces 54*a* and is slidably disposed within the central passage 49*a* for axial movement with respect thereto. A gas-tight seal is effected between the sleeve 40*a* and the unloader piston 50*a* by a lower O-ring 62*a* within the slot 48*a* 62*a* and an upper O-ring 66*a*. With the unloader piston 50*a* in its closed position, the lower O-ring 62*a* is deformed into a gas-tight engagement with three surfaces within the slot 58*a* and the two surfaces 54*a*. The sleeve 40*a* is retained within the unloader assembly opening 121 by a cover 75*a* mounted on the top of the suction line 120 by suitable bolts 82*a*, washers 83*a*, and nuts 84*a*.

An actuator assembly 90*a* is positioned above and coaxially aligned with the sleeve 40*a*. The actuator assembly 90*a* comprises an actuator cylinder 91*a* with a lower end 92*a* and an upper end 93*a* respectively enclosed by a lower and an upper cylinder head 100*a* and 101*a* respectively. An actuator piston 94*a* is slidably disposed within the actuator cylinder 91*a* between the lower and upper ends 92*a* and 93*a* respectively. A sealing engagement between the actuator cylinder 91*a* and the actuator piston 94*a* is maintained by the ring 95*a*. A lower and an upper fluid port 102*a* and 103*a* respectively in the cylinder heads 100*a* and 101*a* communicate an actuating fluid with the actuating cylinder ends 92*a* and 93*a* respectively.

The unloader piston 50*a* and the actuator piston 94*a* are coupled together in axially spaced relation by a connecting rod 105*a* having a lower end 106*a* connected to the unloader piston 50*a* and an upper end 107*a* extending above the upper actuator cylinder head 101*a*. A rod packing gland 112*a* is retained in the cover 75*a* by a packing gland retainer 113*a* and effects a gas-tight seal between the cover plate 75*a* and the connecting rod 105*a* which extends therethrough. The actuator assembly 90*a* includes a base 96*a* attached to the cover 75*a* by bolts 97*a* and correctly positioned thereabove by spacers 99*a*.

A three-way pilot valve 130 includes a spool member slidably disposed therein and selectively directs the actuating fluid into the actuator cylinder ends 92*a* and 93*a*. Movement of the spool member 131 is controlled by a lower and an upper solenoid 132 and 133 respectively connected to sensor means responsive to an operating condition of the gas compressor such as a thermostat 135. The solenoids 132 and 133 and the thermostat 135 are wired together by electrical leads 134 connecting to a suitable power source (not shown).

The pilot valve 130 is connected to a discharge line (not shown) on the high pressure side of the gas compressor by an inlet conduit 136. A lower and an upper exhaust conduit 137 and 138 respectively communicate gas from the pilot valve 130 with the suction line 120 on the low pressure side of the gas compressor by means of a collector conduit 141. The pilot valve 130 is connected to the actuator assembly 90*a* by a lower conduit 139 terminating in the lower fluid port 102*a* and an upper conduit 140 terminating in the upper fluid port 103*a*. The actuating fluid comprises the gas which is pressurized by the gas compressor 2a. The pilot valve 130 in cooperation with the actuator assembly 90 utilizes the pressure differential across the gas compressor to automatically actuate the unloader piston 50a and thereby automatically load or unload the gas compressor.

A closed system is provided by the commpressor unloader apparatus 1a whereby high pressure gas drawn off the discharge side and utilized as an actuating fluid for moving the unloader piston 50a is subsequently returned to the low pressure suction side of the gas compressor at the suction line 120 when the unloader piston 50a reciprocates. Therefore, a pressurized gas such as freon or ammonia which are commonly used in refrigeration systems may be utilized as the actuating fluid within the unloader apparatus 1a without escaping from the closed system.

The actuator cylinder lower end 92a is communicated with the low-pressure suction line 120 by the lower exhaust conduit 137. The resulting pressure differential causes the actuator piston 94a to move downwardly whereby the unloader piston 50a is slid into its closed position closing the ports 45a and gas flow through the suction line 120 is thus prevented and gas compressor is unloaded.

When the operating conditions, for example a higher temperature in a refrigeration system, call for additional compressor capacity, the thermostat 135 energizes the lower solenoid 132, causing the spool member 131 to move to its lower position. Discharge-pressure actuating fluid is thus communicated to the actuator cylinder lower end 92a by the lower conduit 139 and the resulting pressure differential causes the actuator piston 94a to move upwardly, exhausting the actuating fluid within the actuator cylinder upper end 93a to the suction line 120 by the upper exhaust conduit 138. The unloader piston 50a is thus slid upwardly to its open position opening the ports 45a and the compressor is loaded for normal operation at its greater capacity.

Figure 3:
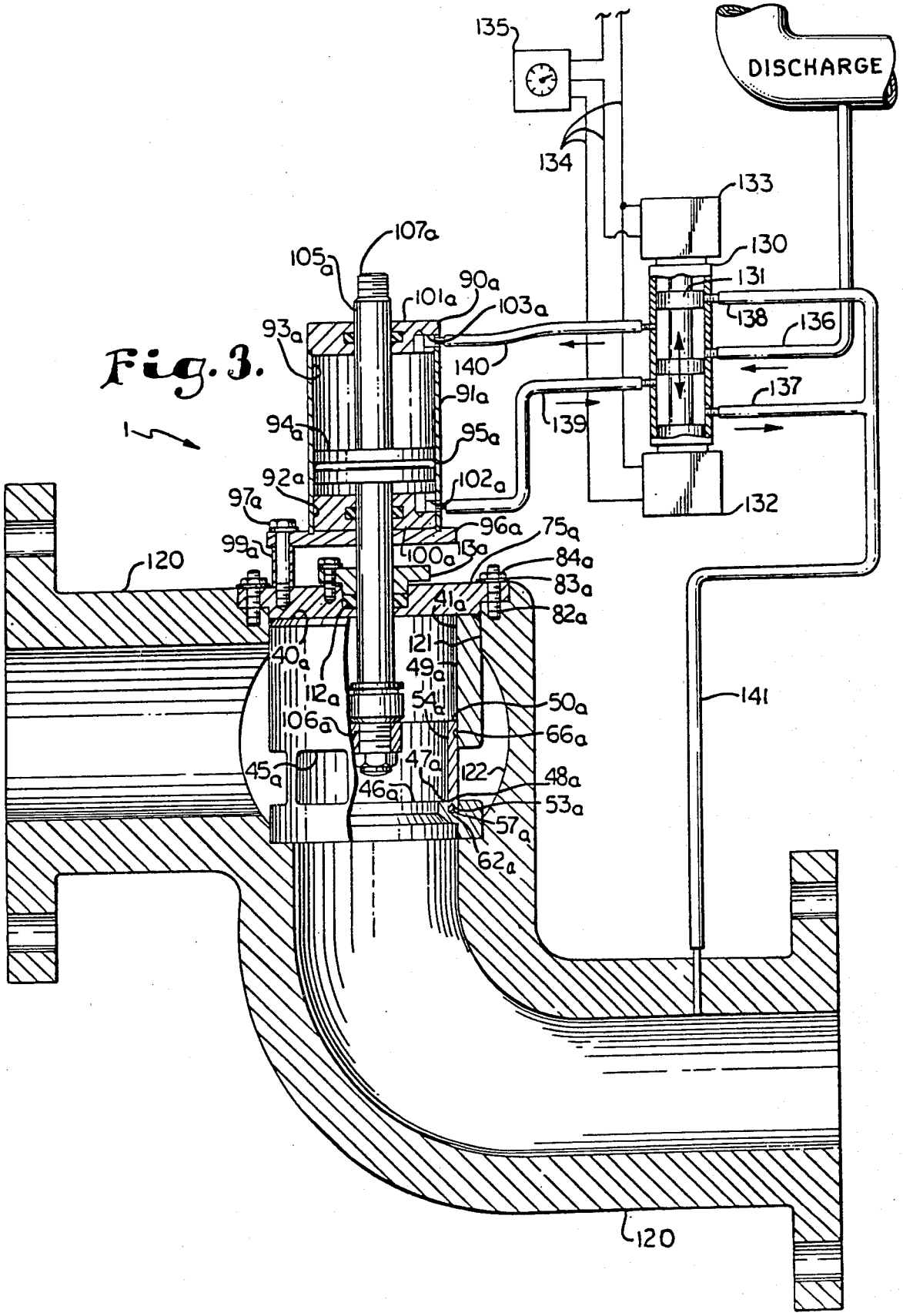
FIG. 3 is a fragmentary, vertical cross-sectional view of a modified embodiment of the present invention showing an unloader apparatus for controlling the capacity of a refrigeration compressor with a pilot valve biased by solenoids.
Figure 4:
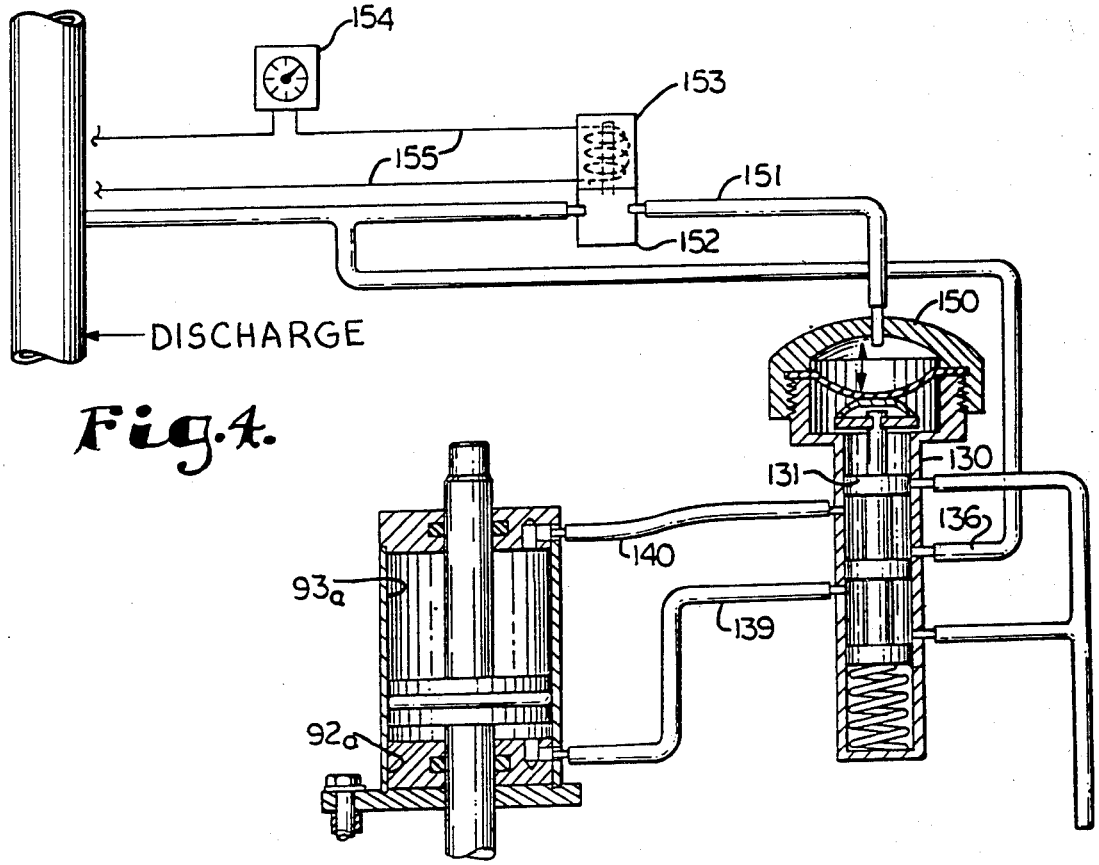
FIG. 4 is an enlarged, fragmentary, view of a second modified unloader apparatus with a pressure diaphragm for biasing the pilot valve.

FIG. 4 shows a second modified embodiment of the present invention utilizing a pressure diaphragm 150 for biasing the pilot valve 130 in an unloader apparatus otherwise substantially identical in structure and function to the compressor unloader designated 1a and illustrated in FIG. 3. The pressure diaphragm 150 is vented to the discharge line (not shown) on the high pressure side of the gas compressor which connects with the inlet conduit 136. A two-way fluid valve 152 is provided in the gas conduit 151 and is biased by a solenoid 153. The solenoid 153 is wired to a thermostat 154 and a suitable power source by electrical leads 155.

In operation, when the thermostat 154 indicates a desired temperature in the refrigeration system, the solenoid 153 is energized and opens the two-way valve 152 to gas flow therethrough from the discharge line to the pressure diaphragm 150. The pressure diaphragm 150 biases the pilot valve spool member 131 to its position as shown communicating high pressure gas from the discharge line to the actuator cylinder upper end 93a whereby the unloader piston is moved to its closed position and the gas compressor is unloaded. When the thermostat 154 indicates a predetermined temperature and calls for cooling capacity from the compressor, the solenoid 153 is deenergized and the two-way valve 152 allows gas flow therethrough from the pressure diaphragm 150 to the discharge line. The spool member 131 is reciprocated by a helical spring 156 to a position communicating fluid from the discharge line to the actuator cylinder lower end 92a. The unloader piston is thus slid to its open position and the gas compressor 2a returned to its normal loaded operating condition.

The pilot valve 130 may thus be biased in any suitable manner depending upon the desired object of control. For example, means responsive to an operating condition such as a predetermined gas pressure can be employed with the present invention. Further, a thermostat or other condition-responsive means may be directly connected to the pilot valve spool member 131 for mechanically biasing it between its respective positions.

It is to be understood that while I have illustrated and described certain forms of my invention, it is not to be limited to the specific forms or arrangement of parts herein described and shown.

What is claimed and desired to secure by Letters Patent is:

1. An unloader apparatus for a gas compressor having a compressor cylinder, a reciprocating compressor piston slidably disposed therein, a suction chamber, and a suction valve having an inlet side communicating with said suction chamber and an outlet side communicating with said compressor cylinder, said unloader apparatus comprising:

(a) a sleeve positioned adjacent said suction valve inlet side, said sleeve having a central passage therethrough and a port for communicating gas from said suction chamber through said central passage to said suction valve inlet side;

(b) said sleeve having an annular shoulder projecting inwardly into said sleeve central passage, said annular shoulder having an upper surface;

(c) a slot encircling said sleeve central passage and opening upwardly onto said shoulder upper surface;

(d) an unloader piston having a central passage therethrough and positioned in said sleeve central passage and axially slidable with respect to said sleeve, said unloader piston being movable between an open position opening said port and a closed position closing said port;

(e) said unloader piston having a lower end extending downwardly into said slot with said unloader piston in said closed position;

(f) said unloader piston in said closed position blocking gas flow from said suction chamber to said suction valve and sealing said compressor cylinder; and (g) actuator means for moving said unloader piston between said open and said closed positions.

2. The unloader apparatus as set forth in claim 1 wherein:

(a) said gas compressor includes a compressor frame having a suction valve opening with said suction valve positioned therein;

(b) said sleeve being positioned in said suction valve opening; and (c) said actuator means being attached to said gas compressor frame in spaced relation outwardly of said suction valve opening.

3. The unloader apparatus as set forth in claim 2 wherein said actuator means comprises:

(a) an actuator cylinder having a first and a second end;

(b) an actuator piston slidably disposed in said actuator cylinder between said first and said second ends of said actuator cylinder, said actuator piston being in axially spaced relation from said unloader piston; and (c) a connecting rod coupled to said unloader piston and to said actuator piston.

4. The unloader apparatus as set forth in claim 3 which includes:

(a) a hub positioned in said unloader piston central passage;

(b) a plurality of spokes extending radially within said unloader piston central passage, said spokes being connected to said hub and to said unloader piston; and (c) a valve cover plate attached to said compressor frame in covering relation over said suction valve opening;

(d) said connecting rod extending through said valve cover plate coaxially with said unloader piston and said actuator piston, said connecting rod being coupled to said hub;

(e) said actuator means being connected to said valve cover plate.

5. The unloader apparatus as set forth in claim 1 which includes:

(a) said suction chamber encircling said sleeve; and (b) a plurality of circumferentially spaced ports extending through said sleeve and communicating gas from said suction chamber through said sleeve central passage when said unloader piston is in its open position.

6. The unloader apparatus as set forth in claim 3 which includes:

(a) a pilot valve for selectively directing an actuating fluid to said actuator cylinder first and second ends respectively;

(b) said pilot valve having a first position communicating gas from said discharge line to said actuator cylinder first end;

(c) said pilot valve having a second position communicating gas from said discharge line to said actuator cylinder second end; and (d) conduit means communicating gas from said discharge line to said pilot valve and from said pilot valve to said actuator cylinder.

7. The unloader apparatus as set forth in claim 6 wherein said conduit means comprises:

(a) a first fluid conduit terminating in said actuator cylinder first end and said pilot valve;

(b) a second fluid conduit terminating in said actuator cylinder second end and said pilot valve; and (c) an inlet fluid conduit terminating in said discharge line and said pilot valve.

8. The unloader apparatus as set forth in claim 6 which includes:

(a) said pilot valve communicating gas from said actuator cylinder second end to said suction line in said first position;

(b) said pilot valve communicating gas from said actuator cylinder first end to said suction line in said second position; and (c) exhaust fluid conduit means terminating in said pilot valve and in said suction line.

9. The unloader apparatus as set forth in claim 6 which includes:

(a) means for moving said pilot valve between said first and said second positions in response to an operating condition of said compressor.

10. The unloader apparatus as set forth in claim 9 wherein said means for moving said pilot valve comprises:

(a) a solenoid operably connected to said pilot valve; and (b) a thermostat selectively energizing said solenoid.

11. The unloader apparatus as set forth in claim 9 wherein said means for moving said pilot valve comprises:

(a) a pressure diaphragm operably connected to said pilot valve;

(b) a gas conduit terminating in said pressure diaphragm and said discharge line; and (c) a two-way valve positioned in said gas conduit and selectively communicating gas from said discharge line to said pressure diaphragm.

12. The unloader apparatus as set forth in claim 11 which includes:

(a) a solenoid operably connected to said two-way valve and moving said two-way valve between said first and said second position; and (b) a thermostat selectively energizing said solenoid.

13. In combination with a gas compressor having a compressor frame, a compressor cylinder, a reciprocating compressor piston slidably disposed therein, a suction chamber, a suction valve having an inlet side communicating with said suction chamber and an outlet side communicating with said compressor cylinder, an unloader apparatus comprising:

(a) a sleeve positioned adjacent said suction valve inlet side, said sleeve including:

(1) a central passage therethrough;

(2) a port communicating gas from said suction chamber through said central passage to said suction valve inlet side; and (3) an annular shoulder projecting inwardly into said sleeve central passage, said annular shoulder having an upper surface and a slot encircling said sleeve central passage and opening upwardly onto said shoulder upper surface;

(b) an unloader piston positioned in said sleeve central passage and axially slidable with respect to said sleeve between an open position opening said port and a closed position closing said port, said unloader piston including:

(1) a central passage therethrough;

(2) a hub positioned in said unloader piston central passage;

(3) a plurality of spokes extending radially within said unloader piston central passage; said spokes being connected to said hub and to said unloader piston; and (4) an end extending into said slot with said unloader piston in said closed position;

(c) an actuator cylinder attached to said compressor frame, said actuator cylinder having a first and a second end;

(d) an actuator piston slidably disposed in said actuator cylinder between said first and said second ends of said actuator cylinder, said actuator piston being in axially spaced relation from said unloader piston; and (e) a connecting rod coupled to said unloader piston hub and to said actuator piston.

14. An unloader apparatus for a gas compressor having a compressor cylinder, a reciprocating compressor piston slidably disposed therein, a suction chamber and a suction valve communicating the suction chamber and the compressor cylinder, which comprises:

(a) a tubular sleeve commmunicating with said suction chamber and having:

(1) a port for communicating gas from said suction chamber through said sleeve to said suction valve;

(2) a central passage therethrough;

(3) an annular shoulder projecting inwardly into said sleeve central passage, said annular shoulder having an upper surface; and (b) a slot encircling said sleeve central passage and opening upwardly onto said shoulder upper surface;

(c) an unloader piston positioned in said sleeve central passage and axially slidable with respect to said sleeve between an open positon opening said port and a closed position closing said port; said unloader piston in said closed position blocking gas flow from said suction chamber to said suction valve and sealing said compressor cylinder; said unloader piston being tubular with a central passage therethrough and said unloader piston having a lower end extending downwardly into said slot with said unloader piston in said closed position;

(d) actuator means for moving said unloader piston between said open and closed positions.

15. The unloader apparatus as set forth in claim 14 which includes:

(a) said slot having a rectangular cross-sectional configuration;

(b) said unloader piston lower end including an annular groove defined by a pair of upwardly converging surfaces; and (c) an elastomeric O-ring positioned in said slot; said O-ring being deformable against said unloader piston groove surfaces and said sleeve shoulder within said slot for effecting a gas-tight seal between said unloader piston lower end and said sleeve shoulder.

16. The unloader apparatus as set forth in claim 14 wherein said actuator means comprises:

(a) an actuator cylinder having a first and a second end;

(b) an actuator piston slidably disposed in said actuator cylinder between said first and said second ends thereof, said actuator piston being positioned in axially spaced relation from said unloader piston; and (c) a connecting rod coupled to said unloader piston and to said actuator piston.

17. An unloader apparatus for a gas compressor having a suction line and a discharge line, which comprises:

(a) a sleeve positioned in said suction line having a port for communicating through said sleeve;

(b) said sleeve having a central passage therethrough open at said port and at said suction line;

(c) an unloader piston positioned in said central passage and axially slidable with respect to said sleeve, said unloader piston being movable between an open position opening said port and a closed position closing said port, said unloader piston in said closed position blocking gas flow through said suction line;

(d) actuator means for moving said unloader piston between said open and closed positions and comprising:

(1) an actuator cylinder having a first and a second end;

(2) an actuator piston slidably disposed in said actuator cylinder between said first and said second ends thereof, said actuator piston being positioned in axially spaced relation from said unloader piston; and (3) a connecting rod coupled to said unloader piston and to said actuator piston;

(e) said sleeve having an annular shoulder projecting inwardly into said sleeve central passage, said annular shoulder having an upper surface;

(f) a slot encircling said sleeve central passage and opening upwardly onto said shoulder upper surface; and (g) said unloader piston having a lower end extending downwardly into said slot with said unloader piston in said closed position.

18. The unloader apparatus as set forth in claim 17 which includes:

(a) said slot having a rectangular cross-sectional configuration;

(b) said unloader piston lower end including an annular groove defined by a pair of upwardly converging surfaces; and (c) an elastomeric O-ring positioned in said slot; said O-ring being deformable against said unloader piston groove surfaces and said sleeve shoulder within said slot for effecting a gas-tight seal between said unloader piston lower end and said sleeve shoulder.

* * * * *